US008051495B2

(12) United States Patent
Lee

(10) Patent No.: US 8,051,495 B2
(45) Date of Patent: Nov. 8, 2011

(54) GARMENT WITH BAMBOO FABRIC LINER

(76) Inventor: Suzanne C. Lee, Atlanta, GA (US)

( * ) Notice: Subject to any disclaimer, the term of this patent is extended or adjusted under 35 U.S.C. 154(b) by 633 days.

(21) Appl. No.: 11/949,147

(22) Filed: Dec. 3, 2007

(65) Prior Publication Data

US 2009/0139003 A1 Jun. 4, 2009

(51) Int. Cl.
*A41D 27/12* (2006.01)
*A41B 9/06* (2006.01)

(52) U.S. Cl. ..... 2/54; 2/400; 2/113; 2/53

(58) Field of Classification Search ..... 2/105, 106, 2/113–114, 115, 125, 126, 69, 120, 53–56, 2/58, 59, DIG. 1, 400–403, 406
See application file for complete search history.

(56) References Cited

U.S. PATENT DOCUMENTS 4,031,568 A * 6/1977 Huff ..... 2/406
4,236,257 A * 12/1980 Williams et al. ..... 2/406
4,244,367 A * 1/1981 Rollenhagen ..... 604/396
4,937,883 A * 7/1990 Shirai ..... 2/115
5,014,360 A * 5/1991 Smith et al. ..... 2/115
5,090,060 A * 2/1992 Gates ..... 2/115
5,105,478 A * 4/1992 Pyc ..... 2/115
5,469,581 A * 11/1995 Uthoff ..... 2/69
5,713,886 A 2/1998 Sturino
5,962,106 A * 10/1999 De Carvalho et al. ..... 428/131
6,282,720 B1 * 9/2001 Mayer ..... 2/113
6,591,425 B1 * 7/2003 Zellers ..... 2/54
6,642,428 B1 11/2003 Kurata et al.
7,060,211 B2 * 6/2006 Oda ..... 264/103
2003/0000665 A1 1/2003 Takai et al.

OTHER PUBLICATIONS

Bamboo Panty 3-Pack by: Spun Bamboo—FaeriesDance.com Internet Web Site publication with copyright date of 2005.
FTC, "Consumer Alert: Have You Been Bamboozled by Bamboo Fabrics?"; Aug. 2009; Exhibit A.
Tenbro, "Tenbro Technical Guidance Documents: 1. Characteristics of bamboo fiber"; 2009; Exhibit B.
Vortex Organics; "Organic Bamboo Clothing: Men's Bamboo Boxer Briefs—Classic Fit"; 2009.

* cited by examiner

*Primary Examiner* — Gloria Hale
(74) *Attorney, Agent, or Firm* — Bryan W. Bockhop; Bockhop & Associates, LLC

(57) ABSTRACT

A garment includes a non-bamboo fabric body portion that has at least one high perspiration area. A bamboo fabric member is affixed to the high perspiration area. In a method of making a lower undergarment, a piece of non-bamboo fabric is cut so as to form an unassembled panty having a crotch member. A piece of bamboo fabric is cut so as to correspond in shape to the crotch member. The piece of bamboo fabric is affixed to the crotch member. The unassembled panty is sewn so as to form a completed panty.

19 Claims, 2 Drawing Sheets

GARMENT WITH BAMBOO FABRIC LINER

BACKGROUND OF THE INVENTION

1. Field of the Invention

The present invention relates to garments and, more specifically, to a garment that has a portion subjected to high levels of perspiration.

2. Description of the Prior Art

Undergarments are worn next to a wearer's skin as an interface between the skin and the wearer's outer garments. There is a wide range of undergarments, such as panties, undershorts and undershirts. Undergarments are worn for a variety of reasons. For example, certain undergarments (such as brassieres and girdles) provide shaping and support for the user. Other undergarments, such as panties and undershirts, are worn for personal hygiene by absorbing perspiration and other materials from the skin and reducing the rate at which they are allowed to reach the outer garments.

Depending on the nature of an undergarment, it can be made from one of several different materials. For example, less stylish undergarments used for absorbing perspiration and heat retention are frequently made of cotton. Undergarments in which appearance is important are often made of synthetic materials and silks.

It is known to line certain stylish undergarments made of synthetic fabrics, such as panties, with a cotton liner. While the outward appearance is of panty has a desired color, sheen and texture, the cotton liner absorbs perspiration. This is done for added comfort and odor reduction.

Since certain area of the body, such as the crotch and the armpits, tend to be relatively warm and perspire at a relatively high rate, bacteria and other microbes tend to grow at a relatively high rate in these areas. Such microbes often generate unpleasant odors and can cause skin irritation. Wearing of cotton undergarments, or undergarments with cotton liners, can reduce the amount of perspiration adjacent to the skin in these areas. However, cotton tends to become saturated quickly and does no inhibit growth of microbes.

Bamboo fabric is a natural textile made from bamboo fibers. Bamboo is a fast growing grass that is highly sustainable. Fabric made from bamboo fibers has excellent wicking properties and may absorb more water than cotton fabric prior to saturation. Bamboo fibers also contain a substance referred to as "bamboo kunh," which has anti-microbial properties. Also, bamboo fabric has a high carbon content and is quite porous so as to have a high surface area. The carbon in bamboo fabric may also bind with organic molecules, thereby interrupting microbe growth.

The bamboo kunh stays in the bamboo fabric even after multiple washings. Thus, clothing made of bamboo fabric has the ability to kill odor causing microbes (such as bacteria, yeast and fungi) that live on human skin, without requiring treatment with harmful chemicals. This feature results in the wearer producing less unpleasant odors for a given perspiration level.

Many fabrics also induce allergies in the wearer, especially in high perspiration zones in which the skin already tends to be tender. Bamboo fabric, on the other hand, is also smooth and hypoallergenic. Thus, even users with sensitive skin can wear bamboo fabric without experiencing allergic reactions.

Unfortunately, because of the nature of bamboo fibers, it is difficult to make bamboo fabrics that are shear enough for certain undergarment applications. Also, certain undergarment styles require a type of sheen that is not readily achieved in untreated bamboo fabric.

Therefore, there is a need for undergarments that have a desired outward appearance, but that absorb high amounts of perspiration and inhibit growth of microbes.

SUMMARY OF THE INVENTION

The disadvantages of the prior art are overcome by the present invention which, in one aspect, is a lower body undergarment having an inside and an outside. The undergarment includes a non-bamboo fabric panty including a crotch member. A bamboo fabric member is affixed to the crotch member so as to line the a portion of the crotch member.

In another aspect, the invention is a garment that includes a non-bamboo fabric body portion that has at least one high perspiration area. A bamboo kunh-enriched fabric member is affixed to the high perspiration area.

In yet another aspect, the invention is a method of making a lower undergarment. A piece of non-bamboo fabric is cut so as to form an unassembled panty having a crotch member. A piece of bamboo fabric is cut so as to correspond in shape to the crotch member. The piece of bamboo fabric is affixed to the crotch member. The unassembled panty is sewn so as to form a completed panty.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
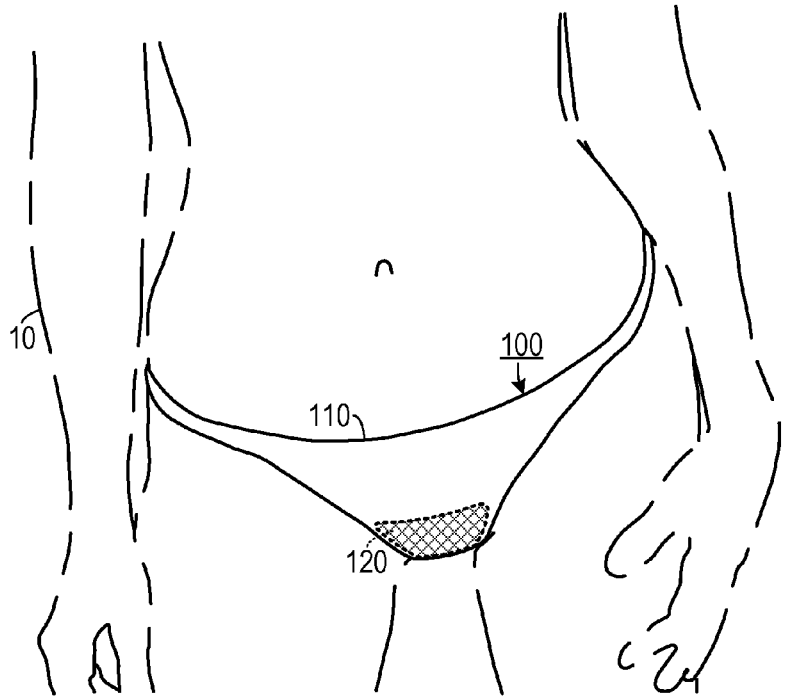
FIG. 1 is a plan view of one illustrative embodiment of a panty shown as it would be worn by a wearer.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on."

One embodiment of the invention is an undergarment that includes a body portion (e.g., a panty or an undershirt) in which a liner made of bamboo fabric is affixed to high perspiration areas (e.g., the crotch or armpits) to facilitate wicking of perspiration and to inhibit growth of microbes.

Figure 2:
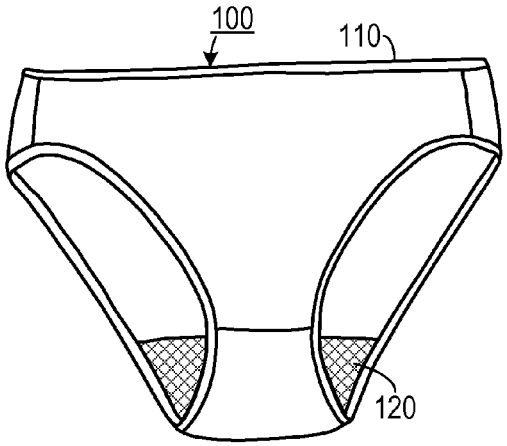
FIG. 2 is a front plan view of a second illustrative embodiment of a panty.

As shown in FIG. 1, one embodiment is an undergarment 100 that includes a panty portion 110 made of a non-bamboo fabric (either synthetic or natural and either knitted or woven) with a bamboo fabric liner 120 (or any other material enriched with bamboo kunh) affixed inside the panty portion 110 at the crotch so as to be worn against a high perspiration area of a wearer's 10 skin. The bamboo fabric liner 120 (which is preferably un-bleached and not treated with any irritating chemicals) wicks perspiration away from the wearer's 10 skin, thereby keeping the wearer 10 dryer. The bamboo kunh in the bamboo fibers of the bamboo fabric liner 120 inhibit the growth of microbes, thereby reducing odor. The bamboo fabric liner 120 in a panty 100 is shown in FIG. 2.

Figure 3:
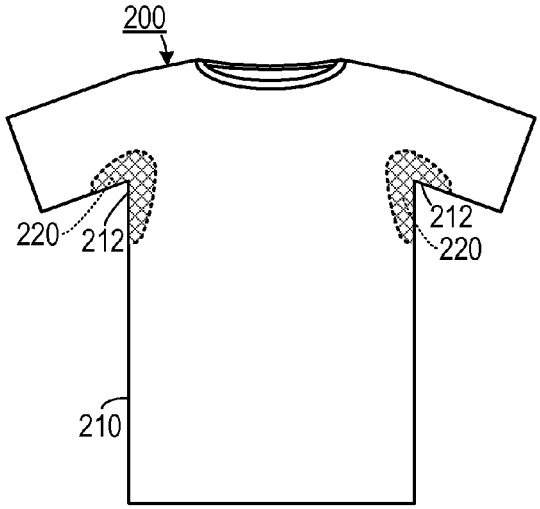
FIG. 3 is a front plan view of an illustrative embodiment of an undershirt.

An undershirt 200 embodiment is shown in FIG. 3. In this embodiment, an undershirt member 210 has a high perspiration area 212 near the armpits. A bamboo fabric liner 220 is affixed to this high perspiration area 212, thereby reducing wetness and odor.

Figure 4A:
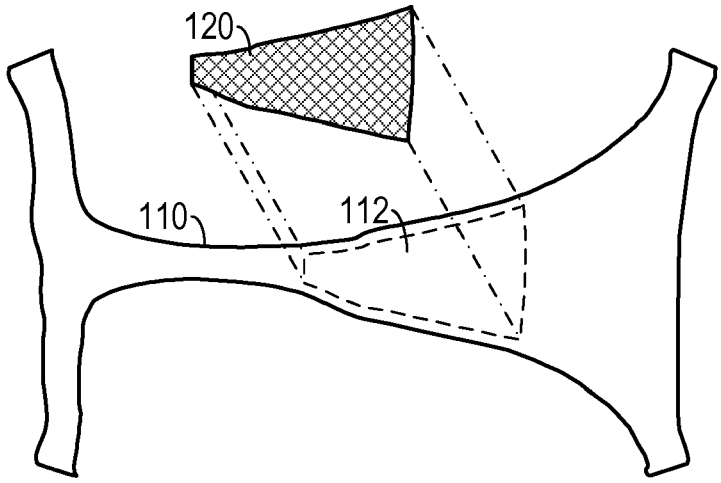
FIGS. 4A-4D are a series of views showing the assembling of a panty according to a first illustrative embodiment of a panty.
Figure 4B:
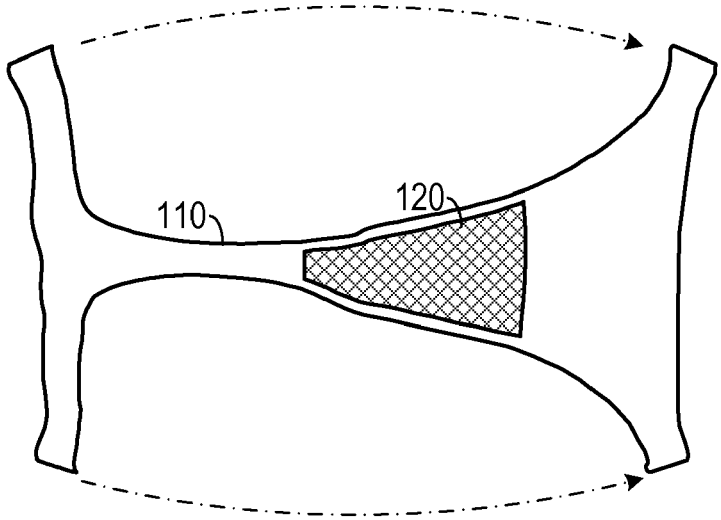
Figure 4C:
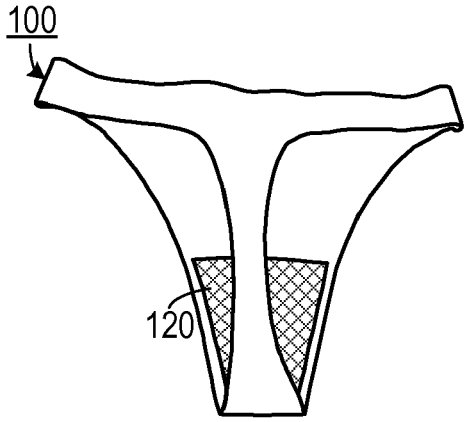
Figure 4D:
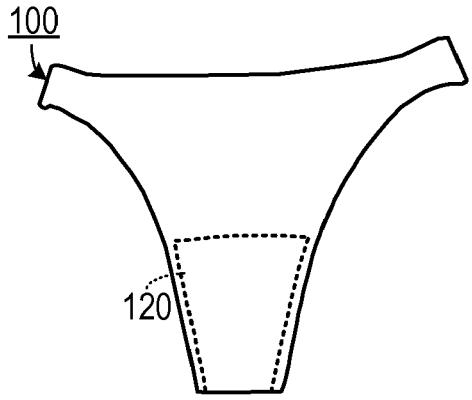

One method of making a panty 100 is shown in FIGS. 4A-4D. A piece of a non-bamboo fabric (e.g., a synthetic fabric made from nylon, such as Tactel®; or a natural fabric, such as silk) is cut to form an unassembled panty 110 having a crotch member 112. A piece of bamboo fabric 120 (or any other bamboo kunh-enriched fabric) is cut so as to correspond in shape and size to the crotch member 112. The piece of bamboo fabric 120 is then affixed to the crotch member 112. This may be done by gluing or sewing the piece of bamboo fabric 120 to the crotch member 112 (or through using any other method of affixing one piece of fabric to another piece of fabric known to the textile manufacturing art). The unassembled panty 110 is then sewn (or otherwise assembled) so as to form a completed panty 100. A rear plan view of the completed panty 100 is shown in FIG. 4C and a front view is shown in FIG. 4D.

While undergarments have been demonstrated in the above disclosure, it should be well understood that other types of garments fall within the scope of the invention. For example, outer shirts employing bamboo fabric liners in the armpit areas would benefit from the moisture wicking an anti-microbial feature of the invention.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A lower body undergarment, comprising:

a. a non-bamboo fabric panty including a crotch member; and b. a bamboo fabric member, consisting essentially of non-viscose bamboo fibers, affixed to the crotch member so as to line a portion of the crotch member.

2. The lower body undergarment of claim 1, wherein the bamboo fabric member is glued to the crotch member.

3. The lower body undergarment of claim 1, wherein the bamboo fabric member comprises unbleached woven bamboo fabric.

4. The lower body undergarment of claim 1, wherein the bamboo fabric member is sewn to the crotch member.

5. The lower body undergarment of claim 1, wherein the panty comprises a synthetic fabric.

6. The lower body undergarment of claim 5, wherein the synthetic fabric comprises a nylon fabric.

7. The lower body undergarment of claim 6, wherein the nylon fabric is knitted.

8. The lower body undergarment of claim 6, wherein the nylon fabric is woven.

9. The lower body undergarment of claim 1, wherein the panty comprises a natural fabric.

10. The lower body undergarment of claim 9, wherein the natural fabric comprises silk.

11. A garment, comprising:

a. a non-bamboo fabric body portion, including at least one high perspiration area; and b. a bamboo fabric member consisting essentially of non-viscose bamboo fibers affixed to the high perspiration area.

12. The garment of claim 11, wherein the bamboo fibers are woven to form a fabric.

13. The garment of claim 11, wherein the bamboo kunh-enriched fabric member is glued to the perspiration area of the body portion.

14. The garment of claim 11, wherein the bamboo kunh-enriched fabric member is sewn to the perspiration area of the body portion.

15. The garment of claim 11, wherein the body portion comprises a panty.

16. The garment of claim 11, wherein the body portion comprises a shirt.

17. A method of making a lower undergarment, comprising the actions of:

a. cutting a piece of non-bamboo fabric, so as to form an unassembled panty having a crotch member;

b. cutting a piece of bamboo fabric consisting essentially of non-viscose bamboo fibers so as to correspond in shape to the crotch member;

c. affixing the piece of bamboo fabric to the crotch member; and d. sewing the unassembled panty so as to form a completed panty.

18. The method of claim 17, wherein the affixing action comprises gluing.

19. The method of claim 17, wherein the affixing action comprises sewing.

* * * * *